US009144721B2

(12) United States Patent
Golden et al.

(10) Patent No.: US 9,144,721 B2
(45) Date of Patent: Sep. 29, 2015

(54) GOLF CLUB HEAD WITH VARIABLE THICKNESS FACE TO BODY TRANSITION

(71) Applicant: Acushnet Company, Fairhaven, MA (US)

(72) Inventors: Charles E. Golden, Encinitas, CA (US); John W. Morin, Poway, CA (US); Darryl C. Galvan, El Cajon, CA (US); Richard L. Cleghorn, Carlsbad, CA (US); Stephen S. Murphy, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 120 days.

(21) Appl. No.: 14/025,535

(22) Filed: Sep. 12, 2013

(65) Prior Publication Data

US 2015/0072803 A1 Mar. 12, 2015

(51) Int. Cl.
*A63B 53/04* (2015.01)

(52) U.S. Cl.
CPC ..... *A63B 53/04* (2013.01); *A63B 2053/045* (2013.01); *A63B 2053/0433* (2013.01); *A63B 2053/0437* (2013.01)

(58) Field of Classification Search
CPC ..... A63B 2053/0437; A63B 2053/0433; A63B 2053/045; A63B 53/0466
USPC ..... 473/349, 345, 346
See application file for complete search history.

(56) References Cited

U.S. PATENT DOCUMENTS

| | | | | |
|---|---|---|---|---|
| 5,004,241 | A | 4/1991 | Antonious | |
| 5,092,599 | A | 3/1992 | Okumoto et al. | |
| 5,318,300 | A | 6/1994 | Schmidt et al. | |
| 5,351,958 | A | 10/1994 | Helmstetter | |
| 5,980,394 | A | 11/1999 | Domas | |
| 5,997,415 | A | 12/1999 | Wood | |
| 6,074,308 | A | 6/2000 | Domas | |
| 6,595,871 | B2 | 7/2003 | Sano | |
| 7,144,331 | B2 | 12/2006 | Poynor | |
| 7,303,488 | B2 | 12/2007 | Kakiuchi et al. | |
| 7,789,773 | B2 | 9/2010 | Rae et al. | |
| 8,226,501 | B2 | 7/2012 | Stites et al. | |
| 8,235,844 | B2 | 8/2012 | Albertsen et al. | |
| 8,241,143 | B2 | 8/2012 | Albertsen et al. | |
| 8,241,144 | B2 | 8/2012 | Albertsen et al. | |
| 8,353,782 | B1 | 1/2013 | Beach et al. | |
| 8,353,786 | B2 | 1/2013 | Beach et al. | |
| 8,360,900 | B2 | 1/2013 | Snyder | |
| 8,460,592 | B2 | 6/2013 | Breier et al. | |
| 8,517,860 | B2 | 8/2013 | Albertsen et al. | |
| 2007/0049400 | A1* | 3/2007 | Imamoto et al. | 473/329 |
| 2010/0048325 | A1* | 2/2010 | Tanimoto | 473/346 |
| 2012/0149494 | A1* | 6/2012 | Takahashi et al. | 473/345 |
| 2013/0344987 | A1* | 12/2013 | Takechi | 473/345 |

* cited by examiner

*Primary Examiner* — Benjamin Layno
(74) *Attorney, Agent, or Firm* — Randy K. Chang

(57) ABSTRACT

A golf club having variable face to body transition is disclosed herein. More specifically, the present invention relates to a golf club head having an indented transition region that helps facilitate the transition of thickness variation from the striking face to a rear aft body. The indented transition region may be located on the crown, the skirt, or the sole, and achieves improved performance by achieving an increased thickness reduction slope.

18 Claims, 13 Drawing Sheets

GOLF CLUB HEAD WITH VARIABLE THICKNESS FACE TO BODY TRANSITION

FIELD OF THE INVENTION

The present invention relates generally to a golf club head with a variable thickness face to body transition. More specifically, the present invention relates to a golf club head having a plurality of indentations around the aft portion of the clubhead that transition from the striking face towards the body portion creating improved performance.

BACKGROUND OF THE INVENTION

In order to improve the performance of a golf club, golf club designers are often faced with the dilemma of trying to maximize the discretionary weight of a golf club, allowing that discretionary weight to be shifted and placed at more strategic locations within the golf club head.

In order to fully understand the challenges behind the very basic design guideline above, it is worth first investigating the meaning and importance of the concept of "discretionary weight". Once the concept of discretionary weight has been explained, the discussion can then move towards how and where to strategically place the discretionary weight within a golf club head to improve the performance of a golf club.

Discretionary weight, as it is commonly known in the golf industry, refers to any additional weight that is not used up in the creation and formation of the basic elements of the golf club such as the face, the crown, the sole, the skirt, the hosel, and or any accompanying components. Because there are several components in a golf club, and each of those specific components has a minimum amount of weight required, there is a "theoretical minimum amount of weight" needed for the formation of a golf club. However, with the advances in material sciences and construction methodology, this "theoretical minimum amount of weight" can often be a floating number that decreases over time, resulting in an increase in the amount of discretionary weight that can be achieved in a golf club head.

Discretionary weight to a golf club designer is important because it allows the center of gravity of the golf club to be changed to achieve center of gravity goals to meet different design objectives. Because the laws of physics govern the impact between a golf club and a golf ball, the resultant trajectory of a golf ball is heavily influenced by the center of gravity of a golf club. Having a low and deep center of gravity will generally promote a golf club with high launching and low spinning golf ball, while having a high and forward center of gravity will promote a low launching and high spinning golf ball. Ultimately, determining the exact location of the center of gravity may be just as much of an art form as it is precise science, but having the maximum amount of discretionary weight allows the golf club designer the flexibility to achieve the maximum amount of center of gravity movements.

Hence, based on the above, it can be seen that one of the main concerns of a golf club designer is to maximize the amount of discretionary weight of a golf club by eliminating weight from locations of the golf club head that are now unnecessary due to certain material, design, or process improvements. By being conscious of the location where weight can be saved increases the discretionary weight, which can ultimately lead to improved golf club performance. U.S. Pat. No. 5,997,415 to Wood illustrates the concept of discretionary weight in a golf club head and one of the earlier attempts of increasing discretionary weight by using rings and frames.

U.S. Pat. No. 5,318,300 to Schmidt shows another one of the earlier attempts to manipulate the thickness of the striking face of a golf club head to improve performance. Although the intent of the Schmidt patent was to improve the ballspeed across the striking face, the thinning of specific portions of the striking face also saves weight and can help increase the discretionary weight.

U.S. Pat. No. 7,144,331 to Poynor shows another attempt to increase the discretionary weight of a golf club by having a wraparound face insert welded to the front face, resulting in an unsupported face area. This concept removes unnecessary material from certain portions of the golf club head to increase the discretionary weight within the golf club head.

Up till recently, most of the manipulation of wall thickness of a golf club head has always been focused on the thickest portion of the golf club head, the striking face. However, this portion of the club head, despite having the highest thickness, can only be thinned so much due to the fact that it must withstand the stresses of an impact with a golf ball. Hence, in order to find more discretionary weight, other portions of the golf club head must also be considered.

U.S. Pat. No. 7,789,773 to Rae et al. attempts to increase discretionary weight by adjusting the crown portion of a golf club head. U.S. Pat. No. 7,789,773 to Rae et al. attempts to do this by altering the geometry of the crown with recesses towards the ground plane to include a plurality of drop angles and recovery angles to create a crown portion that deviates from the conventional shape and geometry. This attempt, although could potentially be helpful in generating more discretionary weight, distorts the aesthetic appeal of a golf club head. Moreover, when the crown of a golf club head is manipulated, it often results in a destruction of the sound quality of golf club, further decreasing its desirability.

Hence, it can be seen that there exists a need for ways to further explore and increase the discretionary weight of a golf club head without disfiguring the aesthetic appeal of the golf club head itself. More specifically, there is a need in the field for ways to increase discretionary weight by focusing on the transition portion between the striking face and the aft portion of the golf club that leads to an increase in performance by normalizing the stresses at the crown portion of the golf club head and preserves the aesthetic appeal and audio feedback of a golf club head.

BRIEF SUMMARY OF THE INVENTION

In one aspect of the present invention is a golf club head comprising a striking face portion located at a frontal portion of said golf club head, a body portion connected to an aft portion of the striking face portion, wherein the body portion further comprises of a crown portion connected to an upper portion aft of the striking face portion, a sole portion connected to a bottom aft of the striking face, and a skirt portion circumferentially connecting the crown portion to the bottom portion. Moreover, at least one of the crown portion, the sole portion, and the skirt portion comprises of an indented transition region, wherein the indented transition region has an Indented Transition Region Thickness Reduction Slope of greater than about 0.06, the Indented Transition Region Thickness Reduction Slope is defined as a change in thickness of the indented transition region divided by a length of the indented transition region.

In another aspect of the present invention is a golf club head comprising a striking face portion located at a frontal portion of said golf club head, a body portion connected to an aft portion of the striking face portion, wherein the body portion further comprises of a crown portion connected to an upper portion aft of the striking face portion, a sole portion connected to a bottom aft of the striking face, and a skirt portion circumferentially connecting the crown portion to the bottom portion. The crown portion further comprises of a central transition region and a plurality of two or more indented transition regions, wherein the plurality of two or more indented transition regions are located away from the central transition region in a heel and toe direction.

In a further aspect of the present invention is a golf club head comprising a striking face portion located at a frontal portion of said golf club head, a body portion connected to an aft portion of the striking face portion, wherein the body portion further comprises of a crown portion connected to an upper portion aft of the striking face portion, a sole portion connected to a bottom aft of the striking face, and a skirt portion circumferentially connecting the crown portion to the bottom portion. Moreover, at least one of the crown portion, the sole portion, and a skirt portion comprises of an indented transition region, wherein the indented transition region is placed internally within a cavity of the golf club head.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
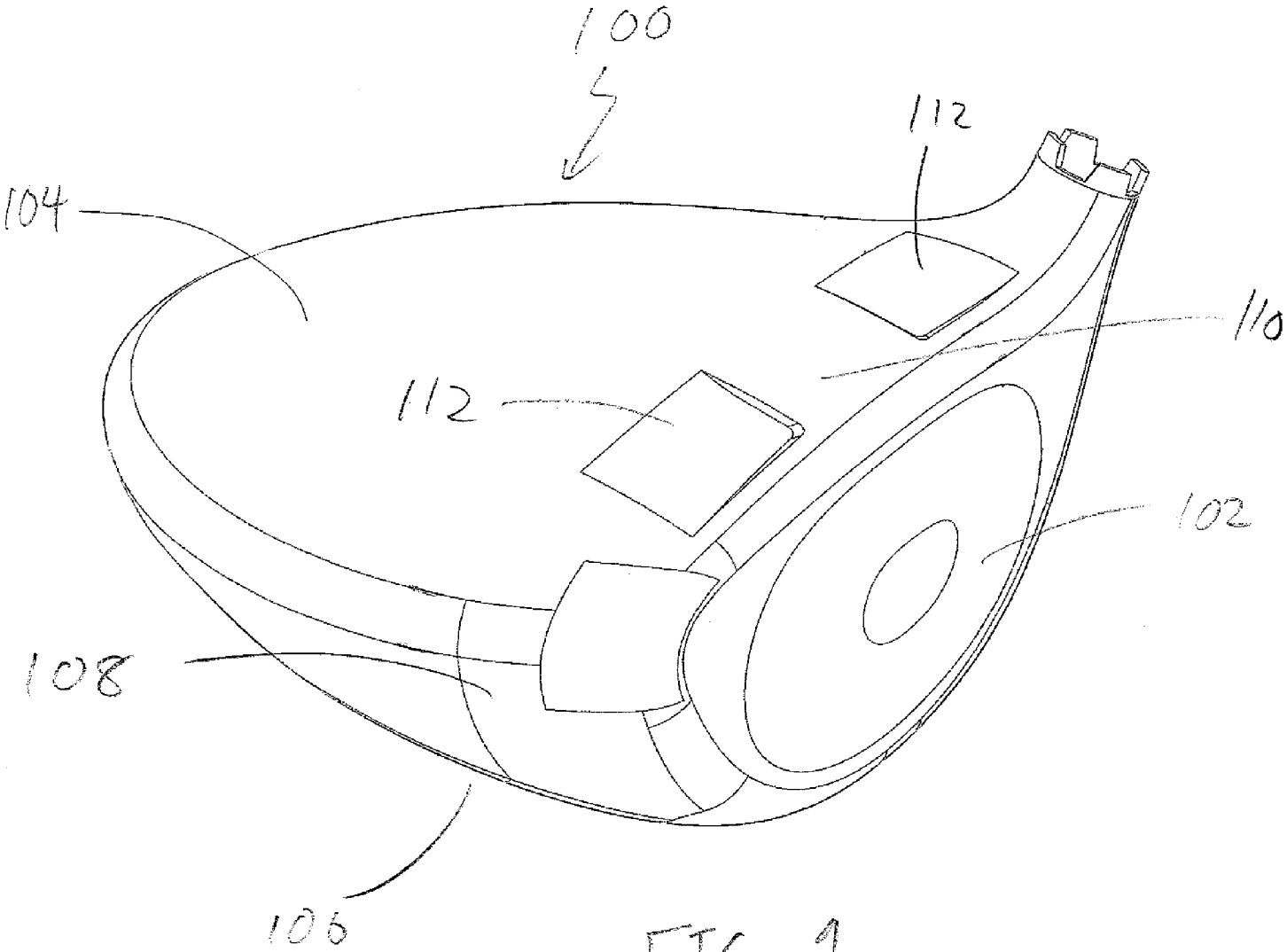
FIG. 1 of the accompanying drawings show a perspective view of a golf club head in accordance with an exemplary embodiment of the present invention.

FIG. 1 of the accompanying drawings shows a perspective view of a golf club head 100 in accordance with an exemplary embodiment of the present invention having a striking face portion 102 and a body portion attached to the rear aft portion of the golf club head 100. The body portion of the golf club head may generally have a crown portion 104 connecting to an upper portion aft of the striking face portion 102, a sole portion 106 connecting to a bottom portion aft of the striking face portion 102, and a skirt portion 108 circumferentially connecting the crown portion 104 with the sole portion 106. In addition, the crown portion 104 of the current embodiment may contain a central transition region 110 and a plurality of two or more indented transition regions 112 to adjust the thickness of the crown portion 102. The plurality of indented transition regions 112 may look like scallops, troughs, concavities, or contain any other indented geometry all without departing from the scope and content of the present invention. In this exemplary embodiment, the plurality of two or more indented transition regions 112 are placed near the frontal portion of the crown 104 near the striking face portion 102 away from central transition region 110 in a heel toe direction. However, in other alternative embodiment, the indented transition regions 112 may be placed at alternate portions of the golf club head 100 without departing from the scope and content of the present invention.

Although the plurality of two or more indented transition regions 112 may look purely like cosmetic features on the crown 104, they actually server several very important functions in improving the performance of a golf club head 100. First and foremost, the plurality of two or more indented transition regions 112, being strategically placed at the location shown, may serve to reduce weight at portions of the crown 104 that experience less stress; thus increasing the discretionary weight of a golf club head 100. The second benefit, being closely related to the first, is the benefit of helping redistribute the high stress levels on the forward portion of the crown 104 away from the part of the crown 104 that experiences the highest stress during impact with a golf ball. The current golf club 100 achieves this by thinning out the heel and toe portion of the crown 104 near the frontal transition with the striking face 102 to help relieve the high stress area that normally occurs at the central transition region 110. Finally, the plurality of two or more indented regions 112 shown in the current FIG. 1 could also be strategically placed to improve the acoustic sound of the golf club head 100 as it impacts a golf ball.

Figure 2:
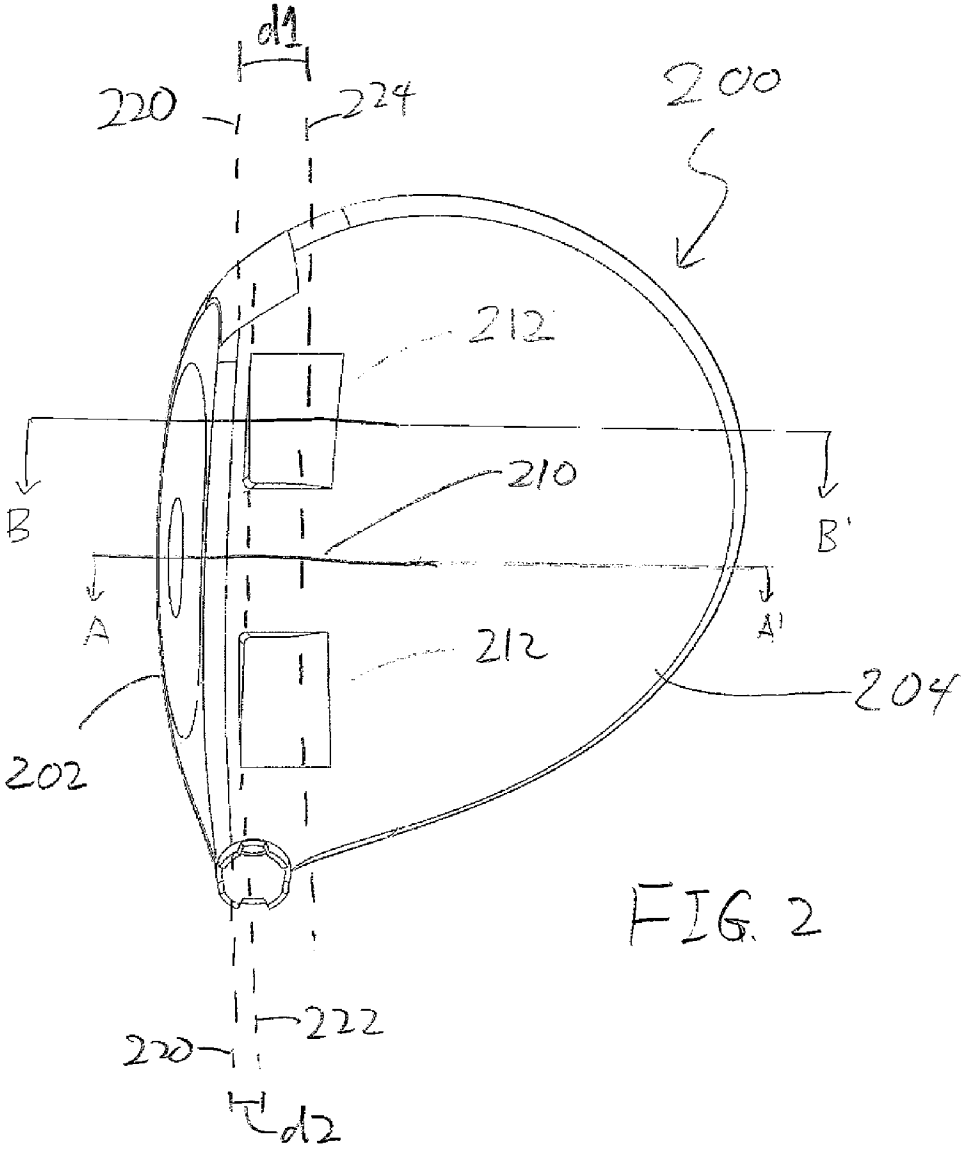
FIG. 2 of the accompanying drawings show a top view of a golf club head in accordance with an exemplary embodiment of the present invention illustrating cross-sectional lines A-A' and B-B'.

FIG. 2 of the accompanying drawings shows a top view of a golf club head 200 allowing cross-sectional lines A-A' and B-B' to be shown. Cross-sectional line A-A' bisects the golf club head in a forward and aft direction, passing through the center of the striking face portion 202. This cross-sectional will allow geometry of the central transition region 210 to be shown more clearly in FIG. 3. In addition to the above, FIG. 2 also allows the cross-sectional line B-B' to be identified, wherein the cross-sectional view of the golf club head along this line will yield more detail regarding the shape and geometry of the plurality of one or more indented regions 212 in FIG. 5.

In addition to providing the information needed for the cross-sectional view of the golf club head 200, FIG. 2 also provides several dimensions that can help describe and distinguish between the central transition region 210 and the plurality of two or more indented regions 212. More specifically, FIG. 2 shows a crown frontal transition line 220 that indicates the beginning portion of the crown 204, a indented region transition line 222 indicating the end of the transition from the face to the crown at the indented region 212, and a central region transition line 224 indicating the end of the transition from the face to the crown at the central region 210; with distance d1 signifying the distance between the crown frontal transition line 220 and the central region transition line 222 and distance d2 signifying the distance between the crown frontal transition line 220 and the indentation region transition line 224. In order to more clearly show the definition and relationship between all the distances, FIGS. 3 through 5 showing the cross-sectional view of the cross-sectional lines A-A' and B-B' are provided.

Figure 3:
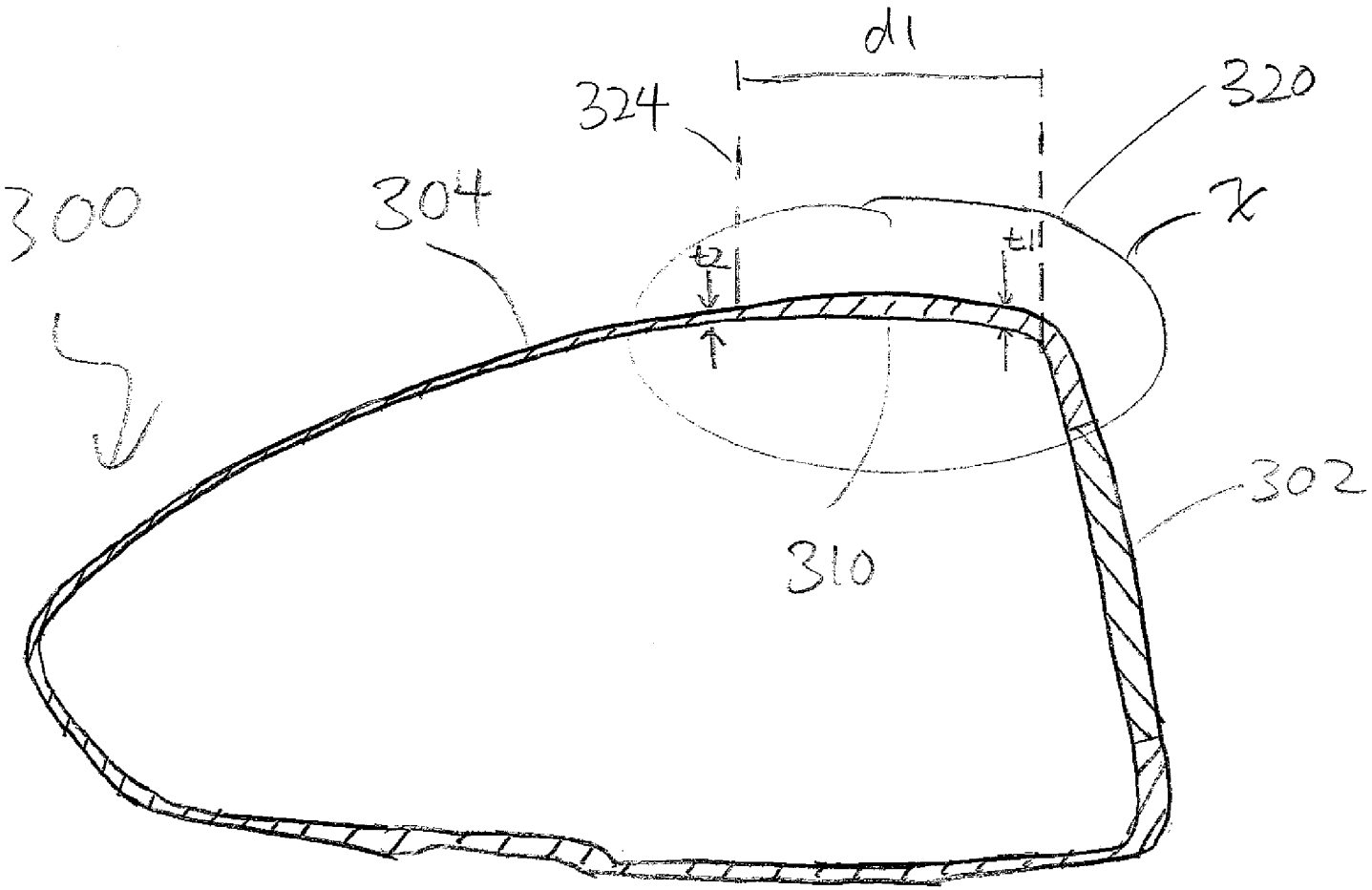
FIG. 3 of the accompanying drawings show a cross-sectional view of a golf club head in accordance with an exemplary embodiment of the present invention along cross-sectional line A-A' as shown in FIG. 2.

FIG. 3 of the accompanying drawings shows a cross-sectional view of a golf club head 300 taken along cross-sectional line A-A' as shown in FIG. 2, illustrating the geometry of the central transition region 310. Based on the cross-sectional view of the golf club head 300, it can be seen that the central transition region 310 changes from a first thickness t1 near the crown frontal transition line 320 to a second thickness t2 near the central region transition line 324 with the central transition region 310 having a length of d1. In order to further examine the transition of the crown portion from a first thickness to a second thickness, FIG. 4 is provided with an enlarged view of circular region x.

Figure 4:
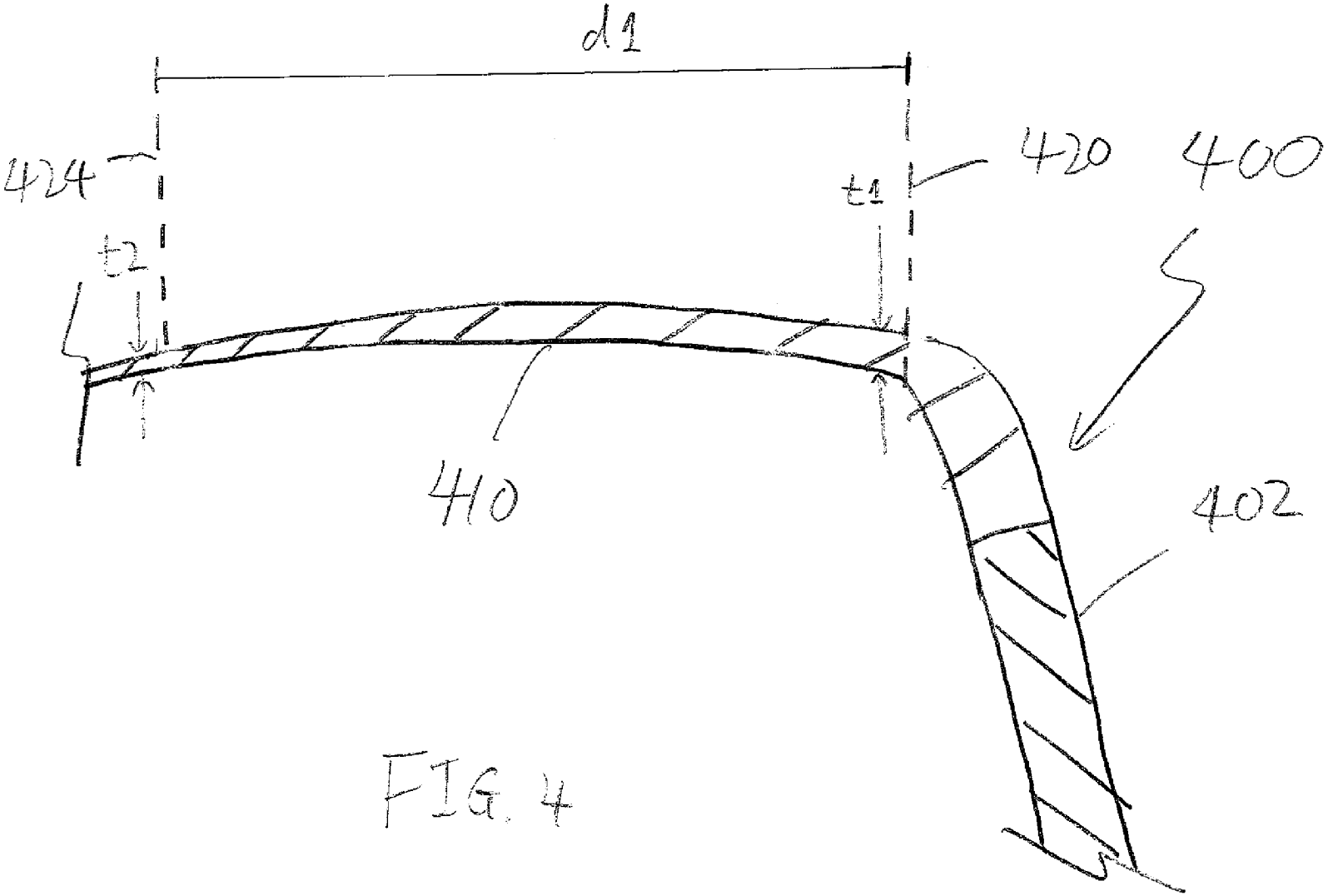
FIG. 4 of the accompanying drawings show an enlarged cross-sectional view of circular region x shown in FIG. 3.
Figure 5:
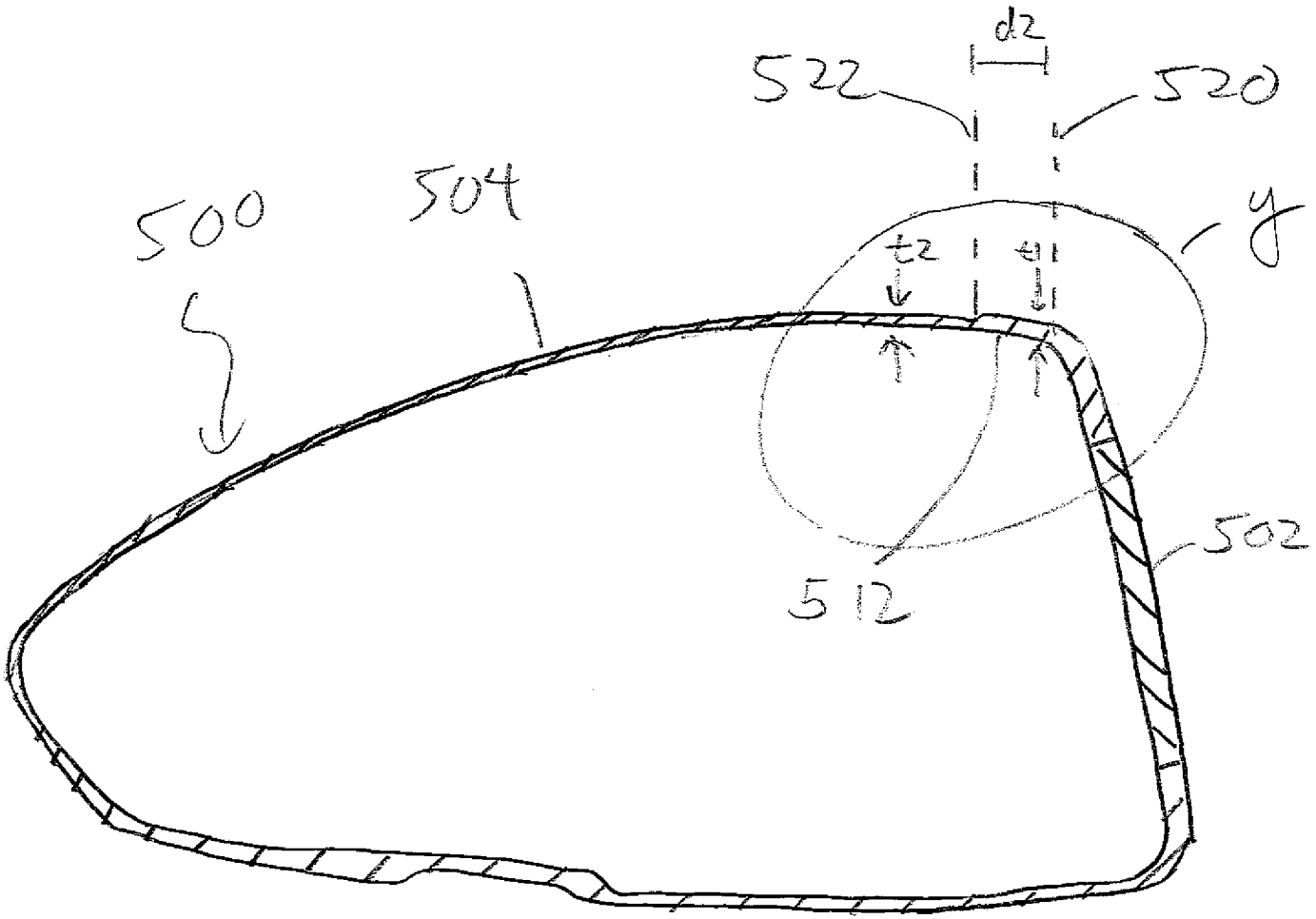
FIG. 5 of the accompanying drawings show a cross-sectional view of a golf club head in accordance with an exemplary embodiment of the present invention taken along cross-sectional line B-B' as shown in FIG. 2.

FIG. 4 of the accompanying drawings shows an enlarged view of the circular region x as shown in FIG. 3, showing the crown transition between the striking face portion 302 towards the crown 304. This enlarged view of the circular region x shows a crown frontal transition line 420 and a central region transition line 424 separated by a distance d1. The crown frontal transition line 420, as shown in the current exemplary embodiment, may generally signify the beginning of the central transition region 410 from the thickened portioned of the crown towards a thinned portion of the crown. This crown frontal transition line 420, as defined in the current invention, is defined as the line that begins at the terminal portion of the internal radius of curvature of the golf club head 400 as it transitions from the striking face portion 402 to the crown. The thickness t1 at the crown frontal transition line 420 may generally be thicker than the rear portion of the crown because it needs to facilitate the transition of thicknesses from the thickest portion of the golf club head 400 to the thinner portion of the crown at the lower stress bearing portion of the crown.

The central region transition line 424, as shown in the current exemplary embodiment, may generally signify the ending of the central transition region 410. This central region transition line 424, as defined in the current invention, is the location of the crown where the thickness decreases to a point equal to or less than 0.50 mm.

Thickness t1 in the current exemplary embodiment may generally be greater than 1.00 mm. Because the rear portions of the crown may not be subjected to as much stress as the frontal portions, the thickness t2 of the crown after the central region transition line 424 may generally be equal to or less than 0.50 mm. Finally, distance d1, illustrating the length or distance it takes to transition from thickness t1 to thickness t2 at the central transition region, may generally be greater than about 10.00 mm, more preferably greater than about 10.50 mm, and most preferably greater than about 11.00 mm. Alternatively speaking, distance d1 refers to the portion of the crown of the golf club head 400, measured in a front to back direction, where the thickness of the crown is equal to or greater than 0.50 mm. In another word, distance d1 refers to the portion of the crown of the golf club head 400, measured from a front to back direction, wherein the thickness of the crown goes from a thickness that is greater than 1.00 mm to a thickness of equal to or less than 0.50 mm.

Based on the thickness of t1 and t2 above, combined with the length d1 it takes to transition from thickness t1 to thickness t2, the central transition region thickness reduction slope can be determined. The central transition region thickness reduction slope may generally refer to the rate of change of the thickness of the crown at the central transition region 410, which may generally be less than about 0.06, more preferably less than about 0.055, and most preferably less than about 0.05. The central transition region thickness reduction slope may be calculated based on Equation (1) below:

$$\text{Central Transition Region Thickness Reduction Slope} = \frac{t1 - t2}{d1} \quad \text{Eq. (1)}$$

FIG. 5 of the accompanying drawings shows a cross-sectional view of a golf club head 500 taken across cross-sectional line B-B', as shown in FIG. 2, illustrating the geometry of the indented transition region 512. Similar to above, it can be seen that the indented transition region 512 transitions from a first thickness t1 near the crown frontal transition line 520 to a second thickness t2 near the central region transition line 324 wherein the indented transition region has a length of d1. Similar to the above description, the first thickness t1 may generally be greater than 1.00 mm, while the second thickness t2 may generally be equal to or less than 0.50 mm.

Figure 6:
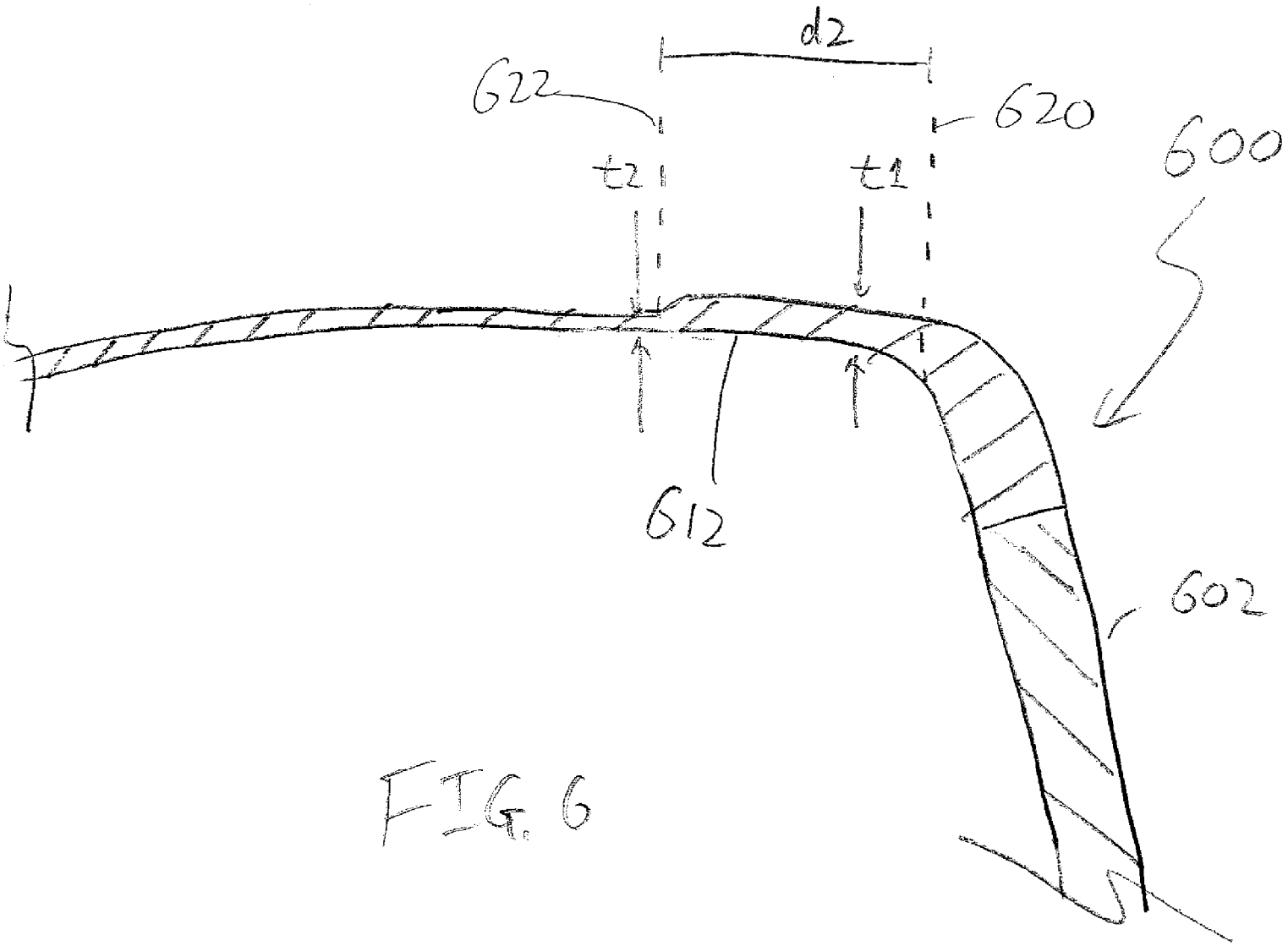
FIG. 6 of the accompanying drawings show an enlarged cross-sectional view of circular region y shown in FIG. 5.

FIG. 6 of the accompanying drawing shows an enlarged view of the circular region y, as shown in FIG. 5, to show the crown transition between the striking face portion 502 towards the crown 504. In this enlarged view, it can be seen clearly that the thickness reduction slope at the indented transition region 612 is very different from the thickness reduction slope at the central transition region 410. Here, the thickness of t1 and t2 are the same, but the distance d2 is significantly smaller than d1, resulting in a higher thickness reduction slope. More specifically, distance d2 may generally be less than about 7.0 mm, more preferably less than about 6.5 mm, and most preferably less than about 6.0 mm. Given the thickness of t1 and t2, combined with the length or distances of d2, the Indented Region Thickness Reduction Slope may be calculated to be greater than about 0.06, more preferably greater than about 0.07, and most preferably greater than about 0.08. The indented transition region thickness reduction slope may be calculated based on Equation (2) below:

$$\text{Indented Transition Region Thickness Reduction Slope} = \frac{t1 - t2}{d2} \quad \text{Eq. (2)}$$

It should be noted that the indented transition region 612 need not have a consistent thickness reduction slope throughout the entire indented transition region 612 to meet the requirements above. In fact, the golf club head 600 shown in FIG. 6 clearly shows this by illustrating a crown transition portion that does not have a consistent thickness reduction slope. The thickness reduction slope described above is only concerned with the distance d2 it takes for the crown portion to transition from any thickness greater than 1.00 mm to a point that has a crown thickness of equal to or less than 0.50 mm.

Figure 7:
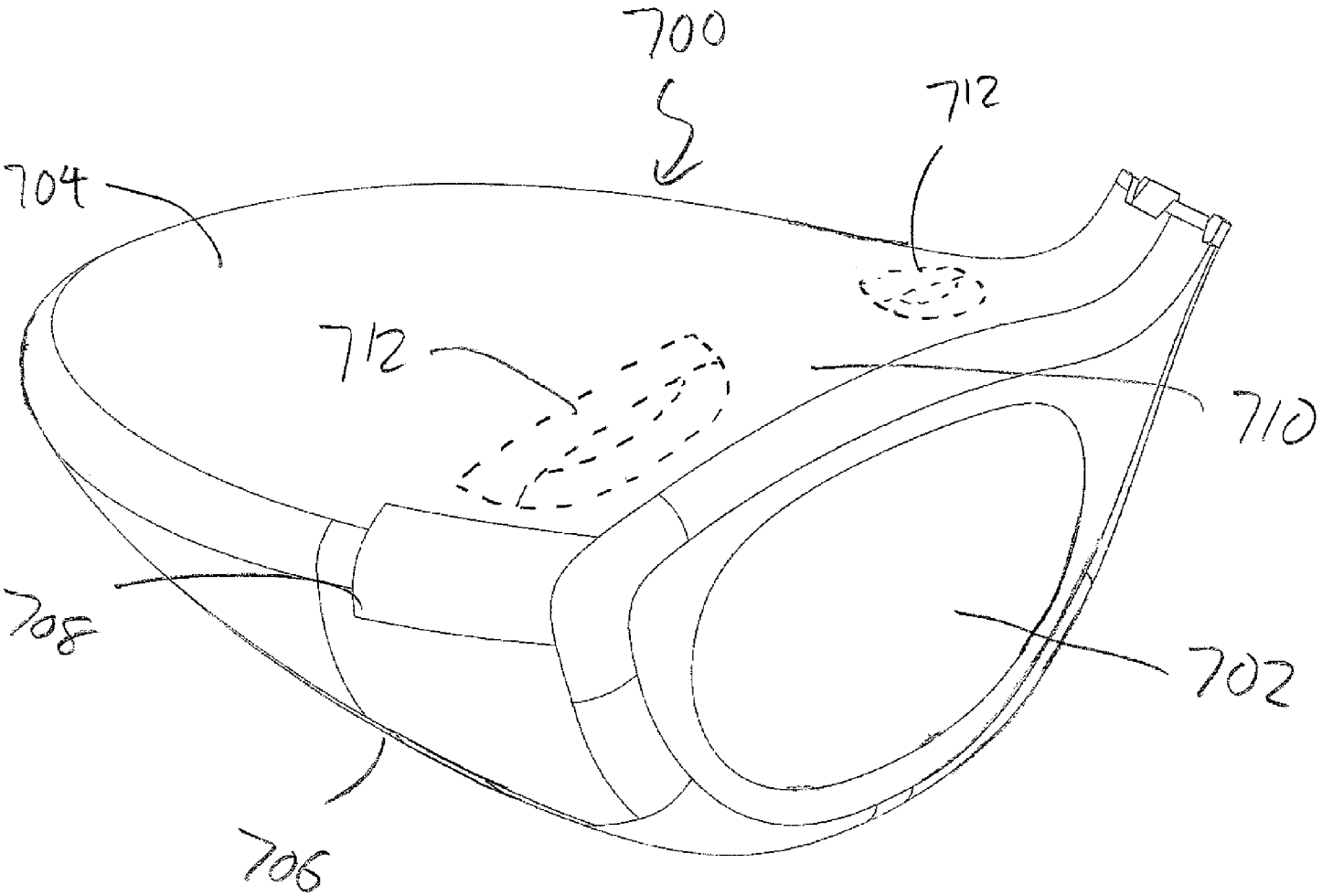
FIG. 7 of the accompanying drawings show a perspective view of a golf club head in accordance with an alternative embodiment of the present invention.

FIG. 7 of the accompanying drawing shows a perspective view of a golf club head 700 having a plurality of two or more crown indented transition regions 712 in accordance with an alternative embodiment of the present invention. Here, the hidden lines in the crown indented transition regions 712 indicate that the change in thickness is occurring internally, hidden from view from the outside of the club head 700. In order to illustrate the shape and geometry of the internal crown indented transition regions 712, the cross-sectional view of the golf club head 700 is shown in FIG. 8, taken along cross-sectional line B-B' as previously shown in FIG. 2.

Figure 8:
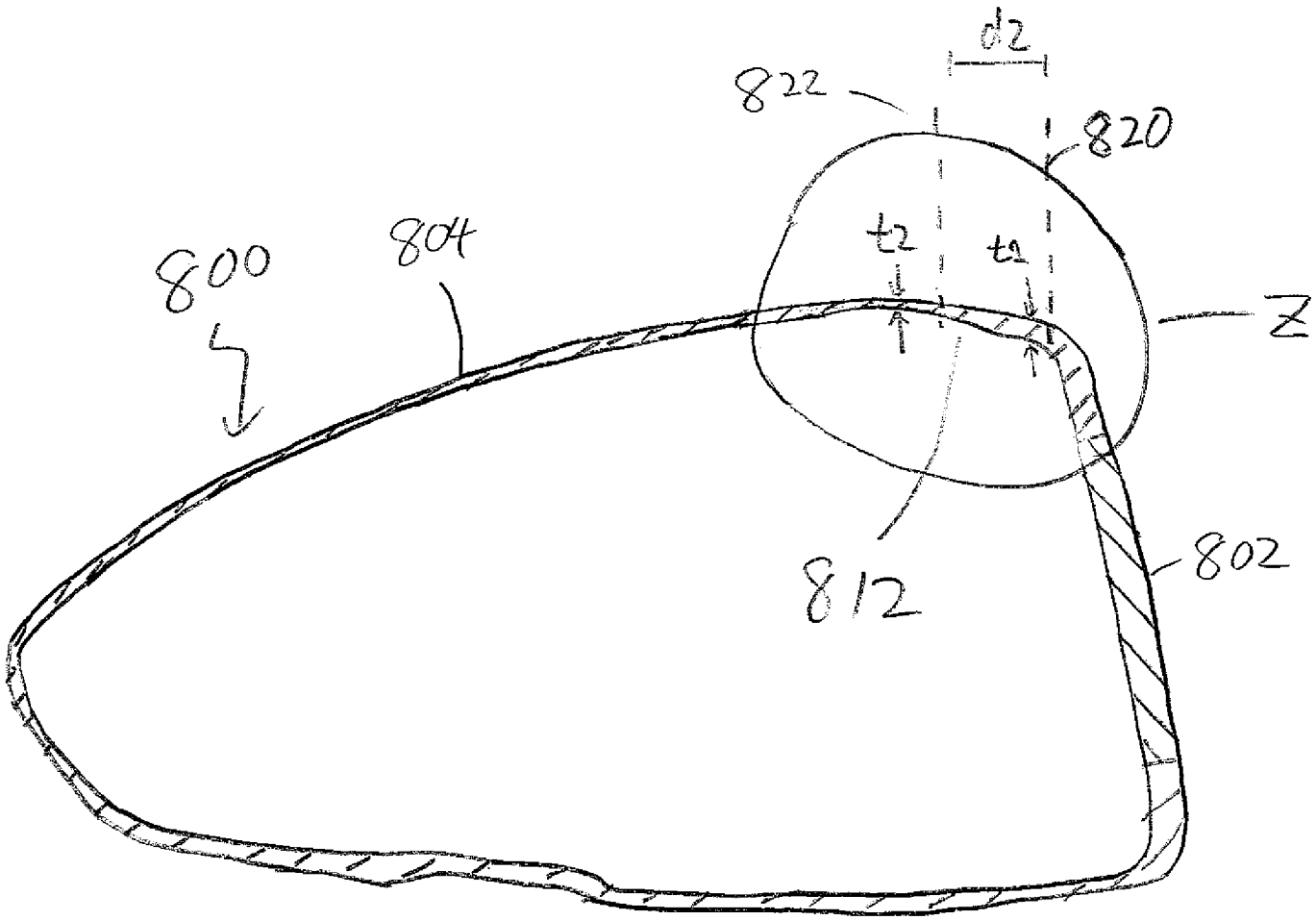
FIG. 8 of the accompanying drawings shows show a cross-sectional view of a golf club head in accordance with an alternative embodiment of the present invention along cross-sectional line B-B' as shown in FIG. 2.

FIG. 8 of the accompanying drawings shows a perspective view of a golf club head 800 in accordance with an alternative embodiment of the present invention taken across cross-sectional line B-B' as previously shown in FIG. 2, illustrating the shape and geometry of one of the plurality of one or more crown indented transition region 812. In this embodiment the indented transition region 812 may have the thickness reduction transition occurring internally within the cavity of the golf club head 800, making the changes in the thickness invisible externally. Here, the thickness t1 of the crown indented transition region 812 at the crown frontal transition line 820, similar to previous discussions, may generally be greater than 1.00 mm; while the thickness t2 of the rear of the crown indented transition region 812 at the indented region transition line 822 may be equal to or less than 0.5 mm. In order to provide a closer view of this crown indented transition region 812, a close up of circular region z is provided in FIG. 9.

Figure 9:
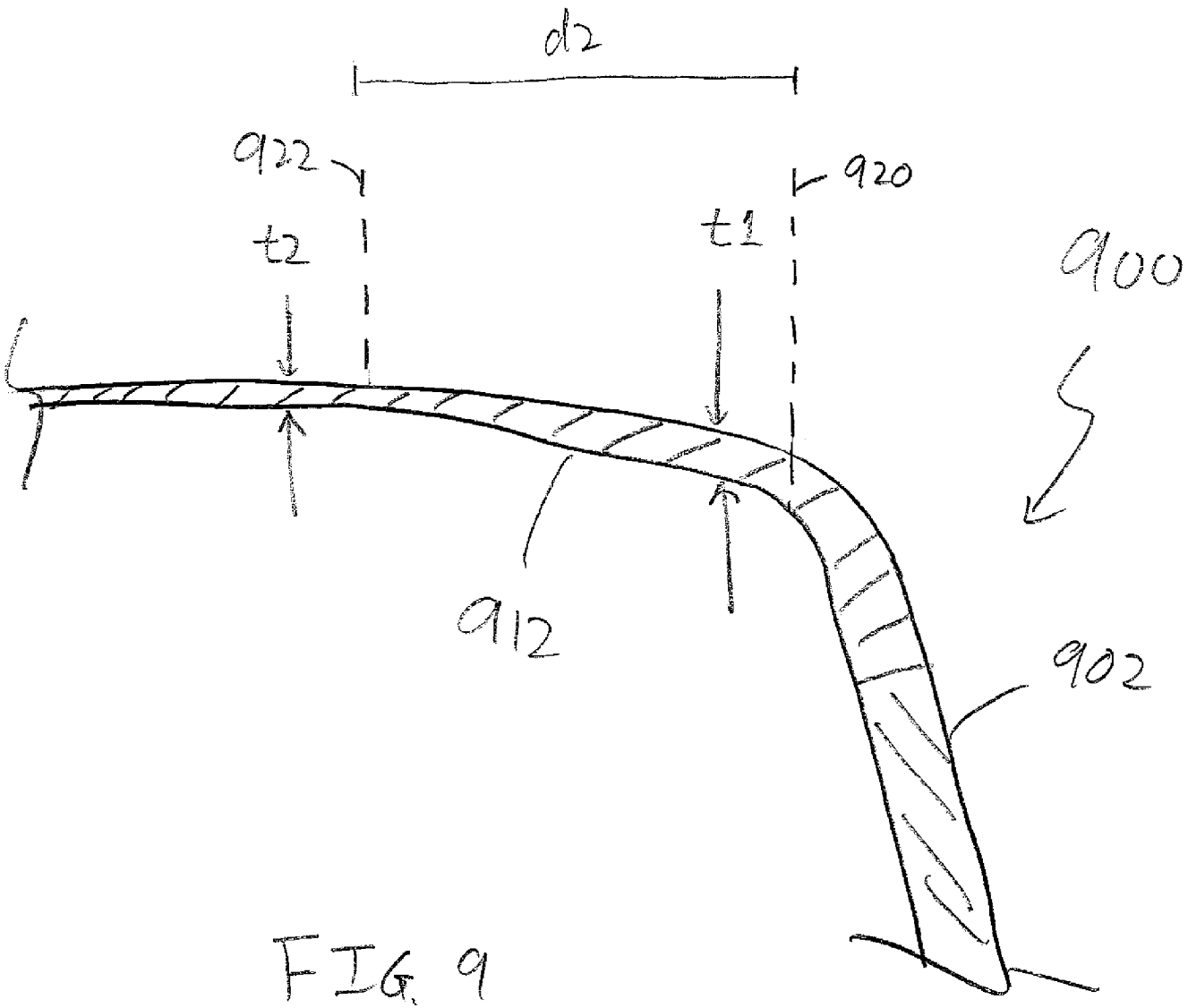
FIG. 9 of the accompanying drawings show an enlarged cross-sectional view of circular region z shown in FIG. 8.

FIG. 9 of the accompanying drawings provides an enlarged cross-sectional view of circular region z as shown in FIG. 8, to illustrate the shape and geometry of the crown indented region 912 between the striking face portion 902 and the crown 904. Here, in FIG. 9, the enlarged view of the internal crown indented transition region 912, shows how the thickness of the crown indented transition region 912 changes from a thickness t1 of greater than 1.00 mm to a point where the thickness t2 is equal to or less than 0.50 mm within an internal cavity of the golf club head 900. As previously mentioned, this change of the thickness can be invisible from an external portion of the golf club head 900. Despite the change in the polarity of the indentation placement, the Indented Region Thickness Reduction Slope, in the current internal embodiment, may generally be the same as if the indentations are external to achieve the same type of weight savings at non-stress bearing portions of the crown. The Indented Region Thickness Reduction Slope in this embodiment may also be greater than about 0.06, more preferably greater than about 0.07, and most preferably greater than about 0.08.

Figure 10:
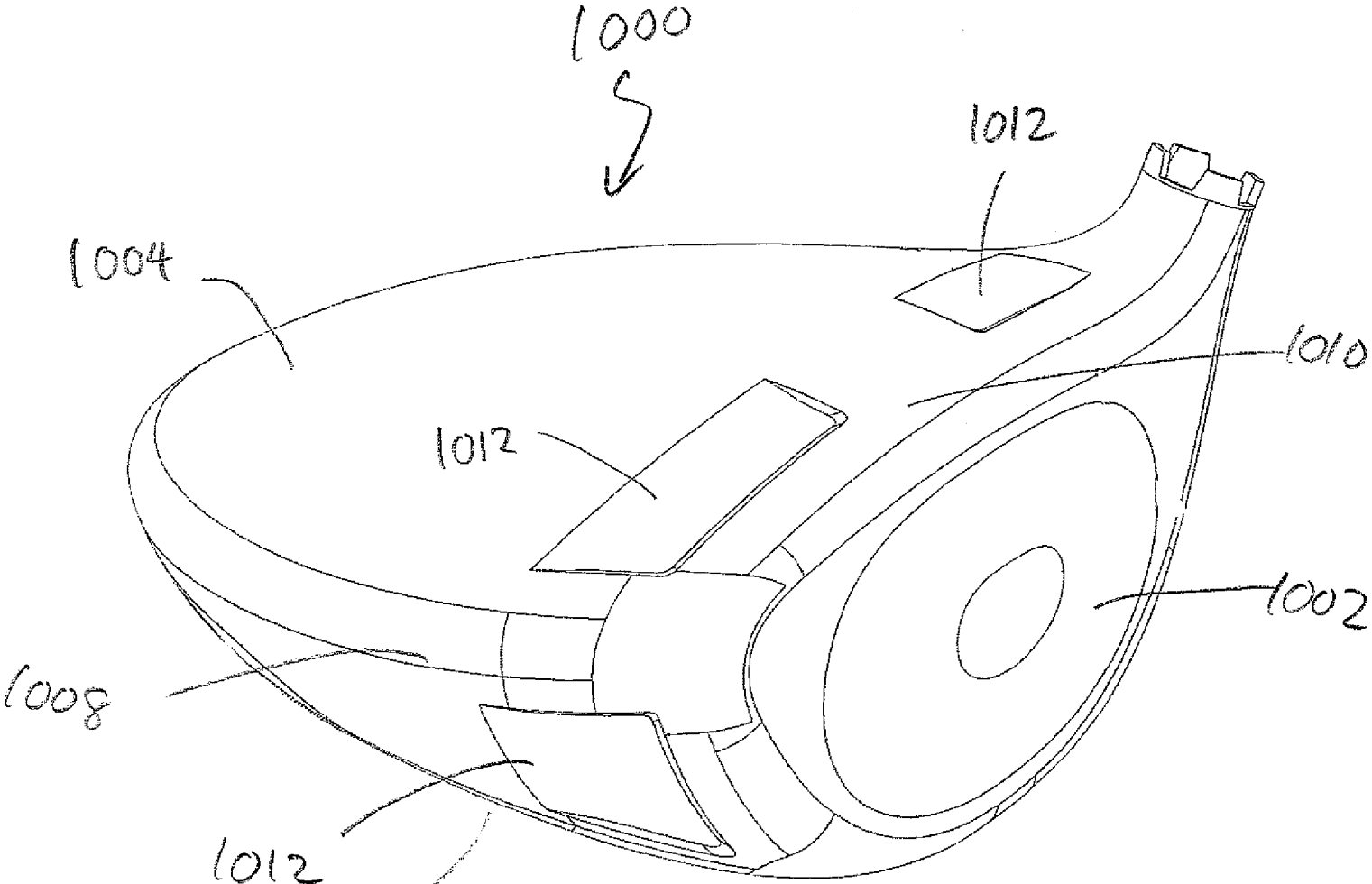
FIG. 10 of the accompanying drawings show a perspective view of a golf club head in accordance with a further alternative embodiment of the present invention.

FIG. 10 of the accompanying drawings shows a perspective view of a golf club head 1000 in accordance with a further alternative embodiment of the present invention. More specifically, the golf club head 1000 shown in FIG. 10 may incorporate one or more indented transition region 1012 that may extend into the skirt portion 1008 of the golf club head 1000 in addition to the indented transition regions 1012 that already exist on the crown portion 1004. The reason that the indented transition region 1012 can also be added to the toe portion of the skirt portion 1008 is because that portion of the golf club head 1000, similar to the heel and toe portions of the crown 1004, may not be subjected to as much stress during contact with a golf ball; allowing excess material to be removed.

Figure 11:
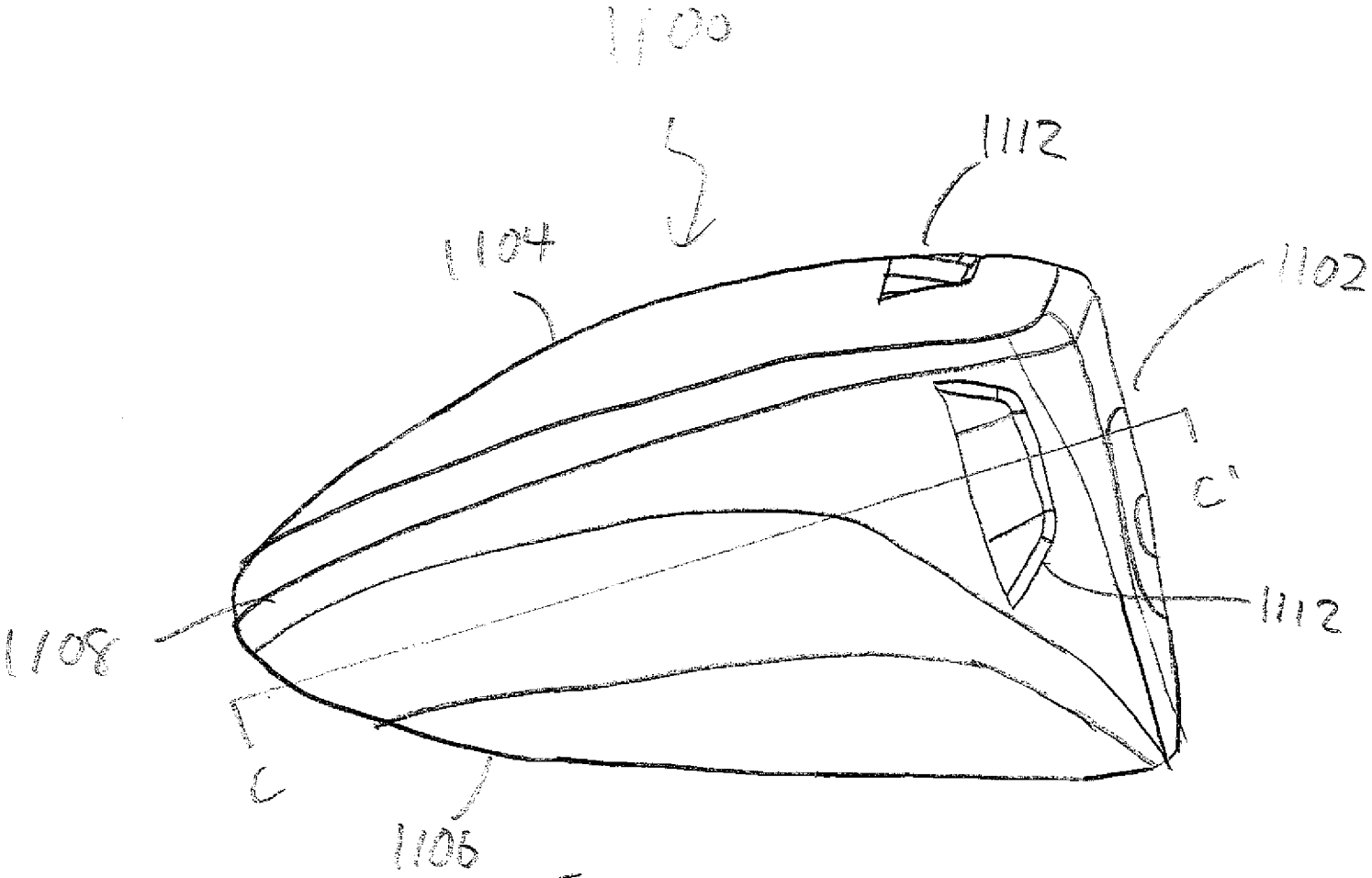
FIG. 11 of the accompanying drawings show a toe side view of the golf club in accordance with a further alternative embodiment of the present invention illustrating cross-sectional line C-C'.

FIG. 11 of the accompanying drawings shows a toe side perspective view of a golf club head 1100 in accordance with this alternative embodiment of the present invention. It can be seen from this figure that cross-sectional line C-C' is created to illustrate the internal shape and geometry of the indented transition region 1112 on the toe portion of the skirt in FIG. 12.

Figure 12:
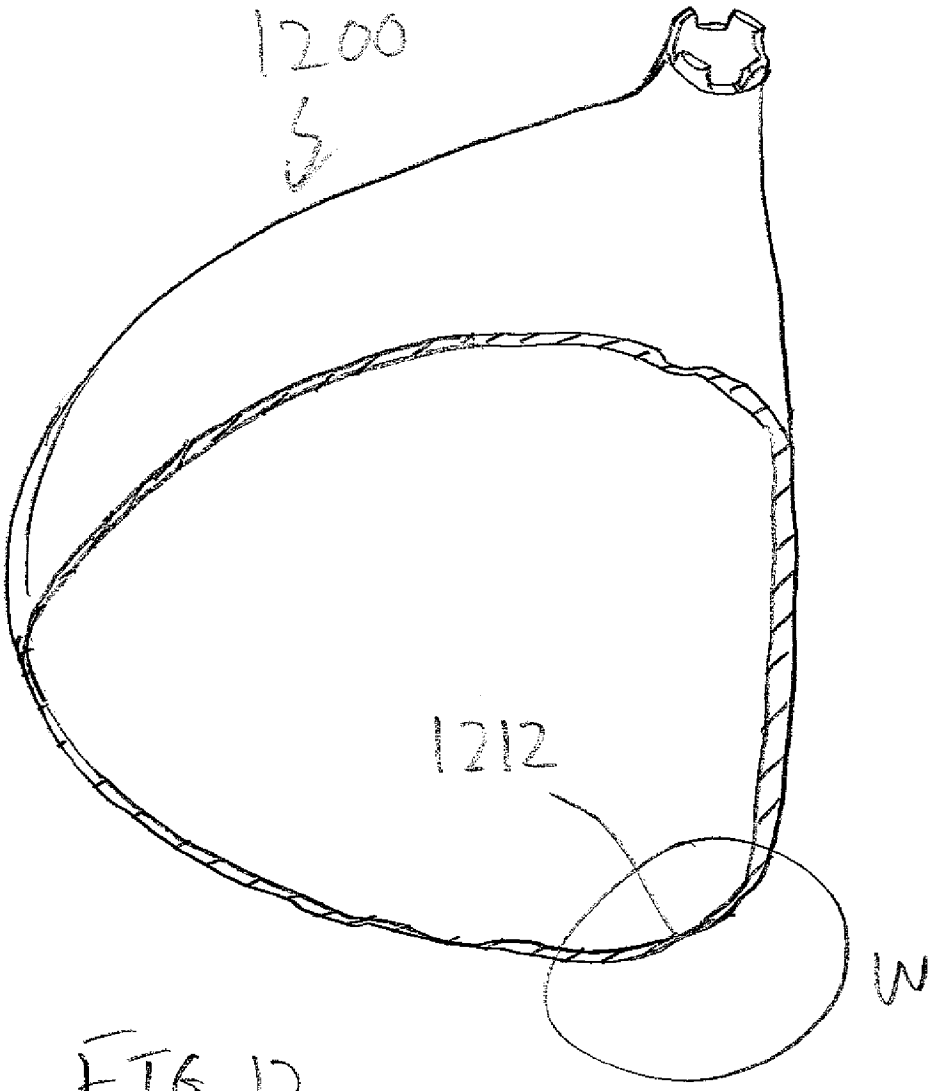
FIG. 12 of the accompanying drawings show a cross-sectional view of the golf club head shown in FIG. 11 taken along cross-sectional line C-C'.
Figure 13:
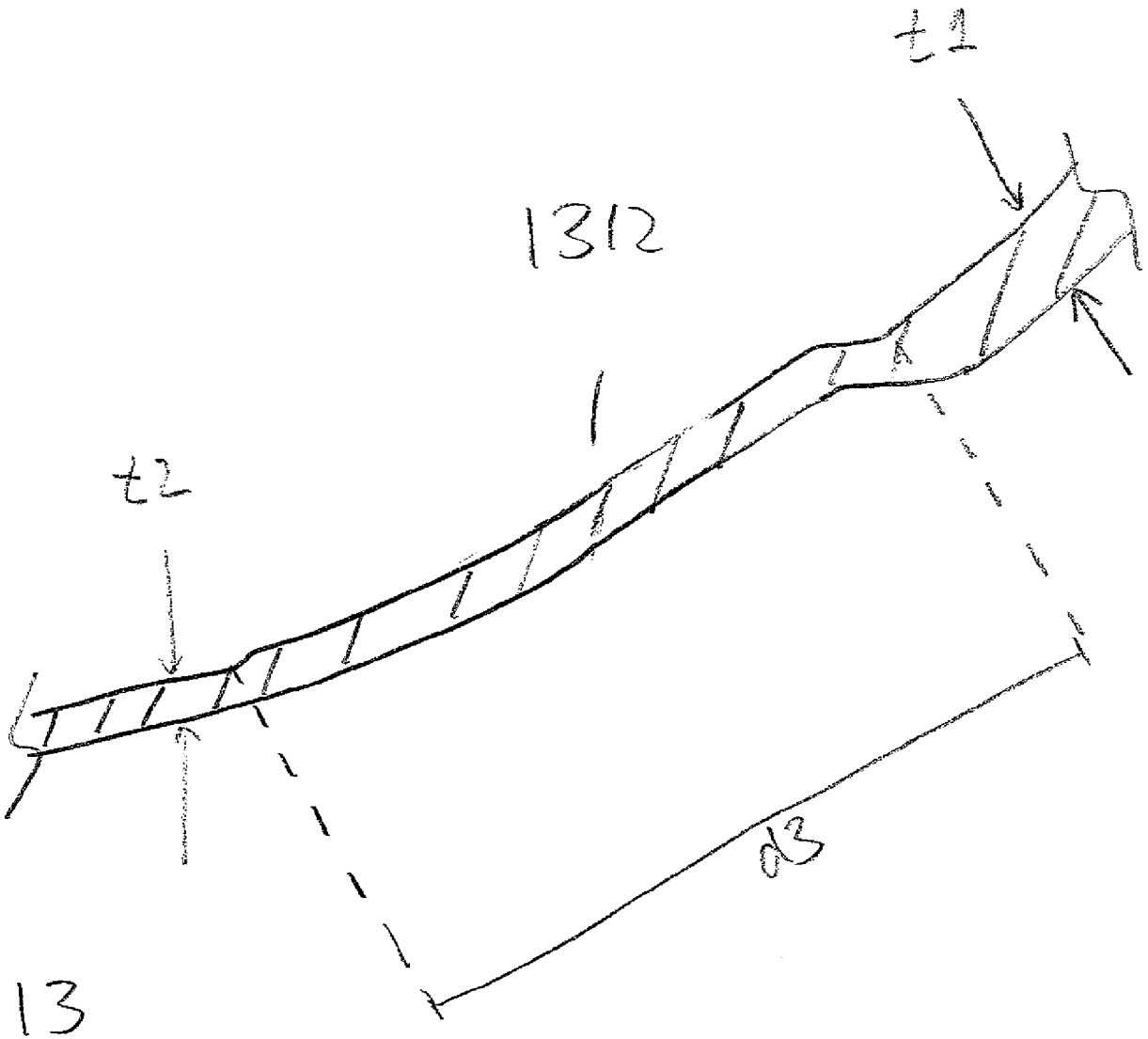
FIG. 13 of the accompanying drawings show an enlarged cross-sectional view of circular region w shown in FIG. 12.

FIG. 12 of the accompanying drawings shows a cross-sectional view of a golf club head 1200 in accordance with this alternative embodiment of the present invention. In this figure, circular region w is identified, allowing a close up of the indented transition region 1212 to be shown in FIG. 13. Similar to the indented transition region 1112 on the crown portion 1104 (shown in FIG. 11), the indented transition region 1312 on the toe skirt portion may also have an Indented Region Thickness Reduction Slope of greater than about 0.06, more preferably greater than about 0.07, and most preferably greater than about 0.08. In order to illustrate the It should be noted here that the toe skirt indented transition region 1312 may exist independently or in conjunction with other indented transition region 1112 in the crown portions (shown in FIG. 11), the heel portion, the sole portion, or even the hosel portion of the golf club head 1100 (shown in FIG. 11) all without departing from the scope and content of the present invention. Alternatively speaking, it can be said that at least a portion of the transition region between the striking face portion to the body portion contains an indented transition region 1312 with an Indented Region Thickness Reduction Slope of greater than about 0.06, more preferably greater than about 0.07, and most preferably greater than about 0.08.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the aforementioned specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head;

a body portion connect to an aft portion of said striking face portion, wherein said body portion further comprises;

a crown portion connected to an upper portion aft of said striking face portion;

a sole portion connected to a bottom portion aft of said striking face portion; and a skirt portion circumferentially connecting said crown portion to said bottom portion;

wherein at least one of said crown portion, said sole portion, and said skirt portion comprises an indented transition region;

said indented transition region has an Indented Transition Region Thickness Reduction Slope of greater than about 0.06;

said Indented Transition Region Thickness Reduction Slope defined as a change in thickness of said indented transition region divided by a length of said indented transition region.

2. The golf club head of claim 1, wherein said Indented Transition Region Thickness Reduction Slope is greater than about 0.07.

3. The golf club head of claim 2, wherein said Indented Transition Region Thickness Reduction Slope is greater than about 0.08.

4. The golf club head of claim 1, wherein said indented transition region is located on a crown portion of said golf club head.

5. The golf club head of claim 4, wherein said intended transition region is located away from a central transition region of said crown.

6. The golf club head of claim 5, wherein said central transition region has a Central Transition Region Thickness Reduction Slope of less than about 0.06;

said Central Transition Region Thickness Reduction Slope defined as a change in thickness of said central transition region divided by a length of said central transition region.

7. The golf club head of claim 6, wherein said Central Transition Region Thickness Reduction Slope is less than about 0.055.

8. The golf club head of claim 7, wherein said Central Transition Region Thickness Reduction Slope is less than about 0.05.

9. The golf club head of claim 1, wherein said indented transition region is located on a skirt portion of said golf club head.

10. The golf club head of claim 1, wherein said indented transition region is located internally within a cavity of said golf club head.

11. A golf club head comprising:

a striking face portion located at a frontal portion of said golf club head;

a body portion connect to an aft portion of said striking face portion;

wherein said body portion further comprises;

a crown portion connected to an upper portion aft of said striking face portion;

a sole portion connected to a bottom portion aft of said striking face portion; and a skirt portion circumferentially connecting said crown portion to said bottom portion;

wherein said crown portion further comprises;

a central transition region; and a plurality of two or more indented transition regions;

wherein said plurality of two or more indented transition regions are located away from said central transition region in a heel and toe direction;

wherein said plurality of two or more indented transition region have an Indented Transition Region Thickness Reduction Slope of greater than about 0.06;

said Indented Transition Region Thickness Reduction Slope defined as a change in thickness of said indented transition region divided by a length of said indented transition region.

12. The golf club head of claim 11, where each of said plurality of two or more indented transition regions all have identical Indented Transition Region Thickness Reduction Slope.

13. The golf club head of claim 11, wherein at least one said plurality of two or more indented transition regions all have a different Indented Transition Region Thickness Reduction Slope than another one of said plurality of two or more indented transition regions.

14. The golf club head of claim 11, wherein said central transition region has a Central Transition Region Thickness Reduction Slope of less than about 0.06;

said Central Transition Region Thickness Reduction Slope defined as a change in thickness of said central transition region divided by a length of said central transition region.

15. The golf club head of claim 11, wherein said plurality of two or more indented transition regions have a length distance of less than about 7.0 mm.

16. The golf club head of claim 15, wherein said length distance is less than about 6.5 mm.

17. The golf club head of claim 16, wherein said length distance is less than about 6.0 mm.

18. The golf club head of claim 11, wherein said indented transition region is placed internally within a cavity of said golf club head.

* * * * *